United States Patent [19]

Norman

[11] 3,960,161

[45] June 1, 1976

[54] PORTABLE STRUCTURE

[76] Inventor: Lowell R. Norman, 4902 Secor, Apt. 20, Toledo, Ohio 43623

[22] Filed: Nov. 5, 1974

[21] Appl. No.: 520,961

[52] U.S. Cl. ..... 135/1 R; 135/4 R
[51] Int. Cl.[2] ..... A45F 1/00; A45F 1/16
[58] Field of Search ..... 135/1 R, 4 R, 3 R, 7.1 R; 5/123, 128, 127

[56] References Cited

UNITED STATES PATENTS

| | | | |
|---|---|---|---|
| 2,325,645 | 8/1943 | White | 135/3 R |
| 2,928,360 | 3/1960 | Heine, Jr. | 135/7.1 R |
| 2,932,304 | 4/1960 | Voege et al. | 135/1 R |
| 2,961,802 | 11/1960 | Mongan et al. | 135/1 R |
| 3,043,320 | 7/1962 | Moss | 135/3 R |
| 3,675,667 | 7/1972 | Miller | 135/1 R |
| 3,699,987 | 10/1972 | Huddle | 135/4 R |
| 3,848,615 | 11/1974 | Warner et al. | 135/4 R |

*Primary Examiner*—Werner H. Schroeder
*Assistant Examiner*—Conrad L. Berman
*Attorney, Agent, or Firm*—Robert E. Pollock

[57] ABSTRACT

Disclosed is a portable structure, a principal utility for which is a tent or the like. The support for the structure typically comprises a continuous loop of a flexible coilable resilient material such as flat spring steel stock. The support is secured to the fabric of the structure at a plurality of points and is preferably continuously held thereto in an elongate pocket. In use, the support is restrained by and supports the fabric and assumes a complex shape dictated by its size and shape of the fabric. Most commonly, the support and the fabric bounded thereby, in use, assumes a generally saddle-shaped configuration. The coilable frame allows the structure to be readily collapsed and virtually self erecting.

5 Claims, 17 Drawing Figures

FIG 1
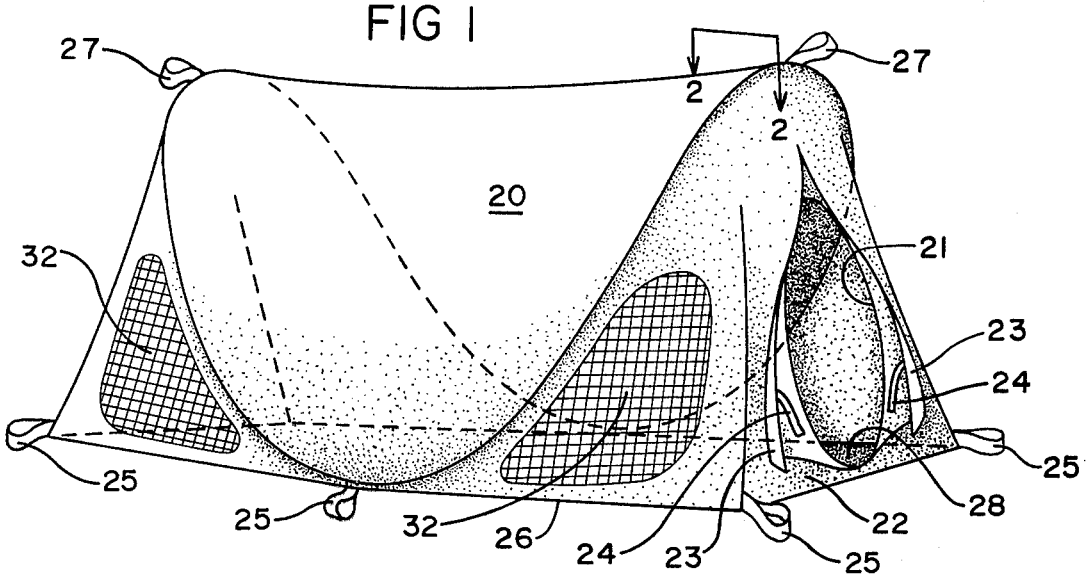
FIG 3
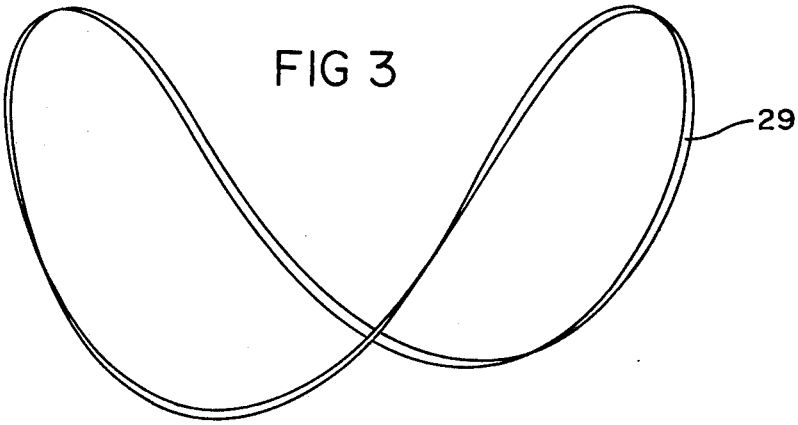
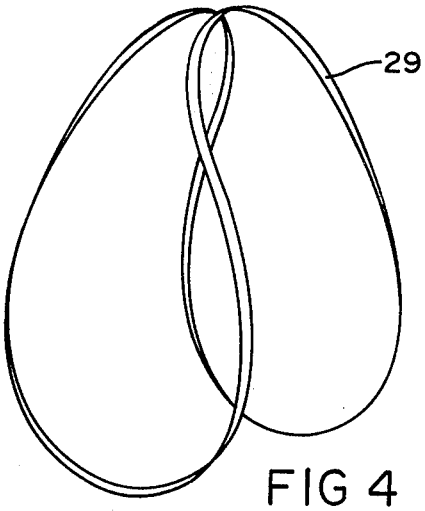
FIG 4
FIG 2
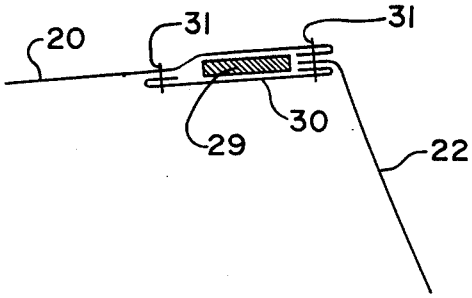

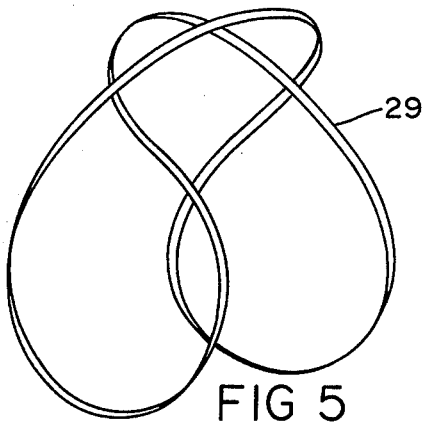
FIG 5
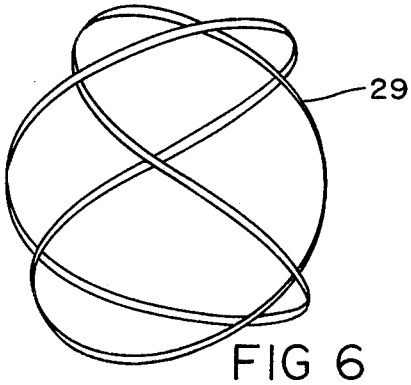
FIG 6
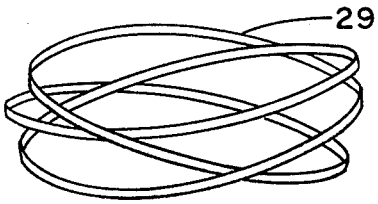
FIG 7
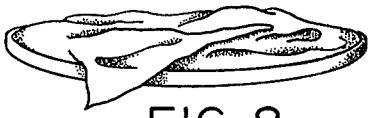
FIG 8
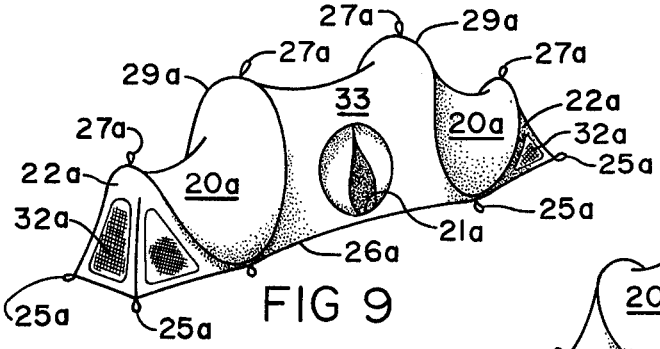
FIG 9
FIG 11
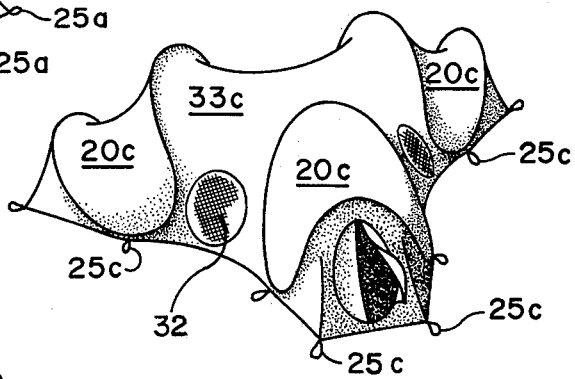
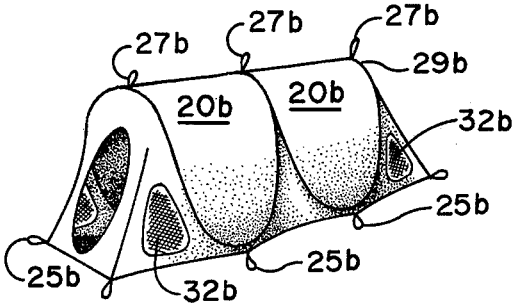
FIG 10
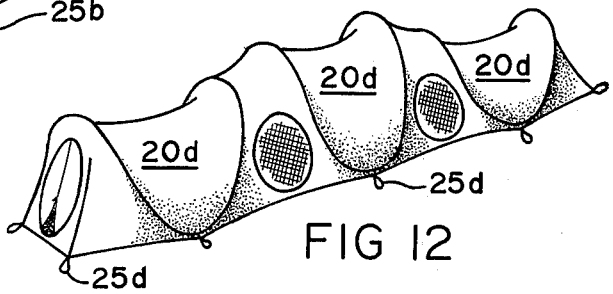
FIG 12

PORTABLE STRUCTURE

BACKGROUND OF THE INVENTION

This invention relates to structures and more particularly to portable structures suitable for shelters and as toys.

Portable structures such as tents have existed for centuries and have always presented problems of various types. One of the principal problems with portable structures is that associated with erecting them. The supports for most portable structures are comprised of a plurality of individual pieces which can be readily lost and which require a substantial amount of time to assemble. Also, erecting portable structures is a generally difficult and sometimes impossible task for one person.

Some attempts have been made to simplify the task of erecting portable structures. As exemplified by the "umbrella" type tent, these attempts have generally resulted in heavier and still more complex structures. These consequences have prevented prior art easy erecting structures from gaining broad popularity.

It is, therefore, an object of the present invention to provide an improved portable structure.

It is further object of this invention to provide such a structure which is extremely simple to manufacture and light in weight.

It is still a further object of this invention to provide such a structure which can be erected readily by a single person and, in fact, can best be described as self erecting.

SUMMARY OF THE INVENTION

These and other objects are realized by the provision of a structure which, in general terms, is comprised of one or more closed loops of flexible coilable material forming frame members which are affixed to a flexible sheet-like material. The material and frame can take on any of a wide variety of specific configurations, as will hereinafter more fully be described.

In one of the simplest embodiments the structure is much like a pup-tent and a single coilable flexible support is employed. The support, because of its constraint, assumes a shape corresponding generally to the periphery of a saddle.

Because of the coilable nature of the support the structure can be "collapsed" in an orderly fashion by manipulating the support member in a simple manner as will be described. Upon collapse, the structure assumes a flat circular configuration which is readily portable and which virtually self-erects upon further manipulation.

More complex structure involving multiple closed loop support members are also possible and a variety of such configurations are described.

BRIEF DESCRIPTION OF THE DRAWINGS

While the specification concludes with claims which particularly and distinctly point out the invention it is believed that the same will be better understood with reference to the following description of the preferred embodiments taken in conjunction with the accompanying drawings in which:

FIG. 1 is a isometric view of a simple tent structure of the present invention;

FIG. 2 is a cross sectional view of the support member taken along line 2—2 of FIG. 1;

FIG. 3 is a view of the support member of the structure of FIG. 1;

FIGS. 4–7 illustrate the manipulation of the support members to collapse the structure;

FIG. 8 is an isometric view of the structure of FIG. 1 in its collapsed condition;

FIGS. 9–13 are isometric views of alternate embodiments of the invention;

DESCRIPTION OF THE PREFERRED EMBODIMENTS

Figure 13:
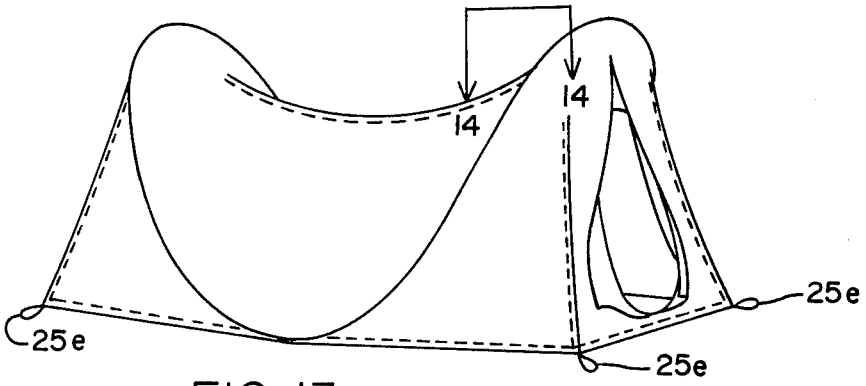

FIG. 1 of the drawing illustrates the present invention in a simple preferred configuation. The structure is that of tent which can be of any size but which will commonly be of such a size to accommodate one or two persons.

Any convenient fabric-like flexible sheet material can be used for the body 20 of the structure. Preferred are materials commonly used in tent and other portable structures. Strong light weight materials such as those made from fibers produced by E. I. Du Pont de Nemours and sold under the trademarks Nylon and Dacron are particularly preferred.

A number of essentially standard features are employed, varying somewhat with personal preference. A passageway is provided in one or more places on the body 20 to provide for ingress and egress. Any suitable passageway can be used and is preferably located in the end panel 22 of the tent. The end panel 22 encloses the otherwise open ends of the body 20 of the tent and has lower edges 26 which extend along the ground somewhat beyond the horizontal extent of the body 20. The preferred embodiment of passageway in the end panel 22, as illustrated, simply involves slitting the end panel 22 to form two opposing flaps 23. A reinforcing panel 21 with a generally circular opening therein is sewn or otherwise secured within the end 22 to provide strengthening thereof. One or more ties 24 are provided on each flap 23 to secure the same together. Similar ties, not shown for clarity, can also be employed on the end panel 22 to alow the flaps 23 to be secured in the open position. A plurality of tie points or loops 25 of any suitable material are provided on the structure and particularly at the corners of lower edges 26 thereof to allow the structure to be secured to the ground. Similar loops 27 can be provided at the upper extremeties of the structure to allow connection thereof to overhanging tree branches or the like to provide additional support for the structure in use.

The structure of FIG. 1 also includes floor 28 which is bound to the body 20 and end panels 22 along the lower edges 26 thereof. Any suitable material, including those used for the body 20 of the structure can be used for the floor 28.

The structure includes a novel support, or frame, member designated generally by the numeral 29. The frame 29 comprises a closed loop of material which is relatively strong and yet is flexible to a sufficient degree to allow it to be coiled. Further, the frame material should be springy in nature and is preferably anisotropic; e.g. by being non-symmetric about its longitudinal axis.

The preferred material for the frame is flat spring steel stock and is preferably of stainless steel so as to be impervious to the elements. Plated or coated spring steel stock can also be used. Other materials useable for the frame include flat plastic materials having relatively high bending modulii and generally oval plastic tubing of such materials. Round or square tubing or solid stock, while less preferred can also be employed.

For the tent shown in FIG. 1 having as approximate length of 8 feet, height of 3½ feet and width of 4 feet the preferred frame member, as seen in FIG. 2, is a flat spring steel stock having a thickness of about 1/16 inch and a width ½ inch. With continuing reference to FIG. 2 it can be seen that the frame member 29 is held relative to the body 20 and end 22 of the structure by retaining means 30 which is secured thereto by, for example, stitching 31. Preferably, the retaining means 30 is continuous and forms, together with body 20 an elongate pocket for locating the frame 29. Although less preferred, the retainer means can comprise discrete members spaced along the frame 29 (not illustrated).

As mentioned previously, the frame member 29, when the tent is in the erected position, has a shape generally corresponding to the periphery of a saddle. More particularly, and as best seen in FIGS. 1 and 2 of the drawings, such a shape is one in which the frame 29 constitutes a smooth continuous curve with a pair of opposed lower portions adjacent the lower edge 26 and a pair of smooth elevated curves spaced therebetween and providing the support for the roofline. Such a saddle shape results from the restraints imposed on the frame member 29 by the body 20 alone or more commonly in conjunction with additional elements, such as end panels 22, floor 28 and ties 25. The frame 29 is supported by the ground only along a limited length of the opposed lower portions. Thus the ties 25 at the lower corners of the structure are necessary to provide support stability in use. Additionally, such ties serve to tension the body 20 because, when secured to the ground, they pull downwardly and outwardly on the frame.

Any other conventional features can be used with the present structure. Referring again to FIG. 1, for example, mesh screens 32 can be employed as desired in the known manner to provide ventillation for the structure.

Typically, for ease of construction, the body 20 will be formed as a single piece (although it may contain seams) and will be generally oval prior to its assembly into the final structure. The floor 28, if used will be formed as a single flat sheet. The end panels 22, comprising the remainder of the structure, will be formed from one or a plurality of pieces as dictated by convenience and the desired end result. The end panels 22, frame 29, retaining means 30 and body 22 are then assembled as shown, thereby forming the final structure. Other sequences of assembly can, of course, be employed.

It should be noted that the ratio of the major to minor dimensions of the material forming the body has a significant effect on the in-use appearance thereof. For the structure shown in FIG. 1 this ratio is about 2:1. As can be seen, such ratio provides a relatively taut "roof line".

The steps required to set-up or collapse the structure shown in FIG. 1 can best be described with reference to FIGS. 3–7 which illustrate the sequence showing only the frame 29. FIG. 3 shows the frame 29 in the configuration it assumes when the structure is erected. To collapse the structure, the two upper corners are pulled inwardly toward one another as shown in FIG. 4. One of the ends is thereupon pulled over the other, as in FIG. 5. The lower portions are pulled within one another either by hand or by virtue of the forces imposed on them by the previously described manipulation, depending on the structure and the nature of the frame 29, to the point shown in FIG. 6. At this point, the frame virtually collapses to the configuration shown in FIG. 7. Upon complete collapse, the entire structure assumes a flat disc-like configuration as shown in FIG. 8. In this position the structure is readily transported and for a structure of the aforedescribed size will be about 30 inches in diameter. If desired, the structure can be further manipulated in a sequence similar to that illustrated in FIGS. 3–7 to reduce the diameter to about 10 inches.

Erecting the structure from its transport configuration requires simply the reversal of the steps illustrated in FIGS. 3–7. Once the frame has reached the position shown in FIG. 5 it opens the remainder of the way itself. Indeed, the procedure is do simple that the structure can best be described as self erecting.

FIGS. 9–17 illustrate variations of the basic structure of FIG. 1 and parts corresponding thereto are similarly numbered but with a, b and c suffixes respectively. In FIG. 9, two spaced frame members **29*a* and their corresponding body sections 20*a* and end sections 22*a* are provided in spaced apart relationship. A connecting panel 33 is provided between and secured to the two body panels 20*a*. As will be observed in this embodiment the two frame members 29*a* and body panels 20*a* are non-symmetrical longitudunally. Such an arrangement can be useful in many structures of the present invention and is simply achieved by the initial shape of the body members 20*a*. The passageway 21*a* in this embodiment is preferably through the connecting panel 23**.

FIG. 10 illustrates a further variation of the invention utilizing two identical and abutting individual frame members **29*b***. Such an arrangement allows the overall structure to be elongated and enlarged without increasing the major dimension thereof when in its transport position. As will be recognized, with this and all multiple frame member structures, each frame member is individually collapsed in the manner previously outlined.

FIG. 10 further illustrates the effect of varying the ratio of the major to the minor dimensions of the oval forming the body **20*b*. With a ratio of about 3:1, as illustrated, the structure is relatively tall and the roof line becomes increasingly taut. The upper loops 27*b*** at the ends of any of the described structures can be tied to the ground as well as to elevated supports and such connection is particularly described in the structure with a high major dimension ratio.

FIG. 11 shows still another structure utilizing the basic principles of the invention. This embodiment utilizes three individual frame members but is otherwise similar to that of FIG. 9.

The embodiment of FIG. 12 employs two identical end frame members surrounding the end body panels **20*d* thereof, a third central body panel 20*d*** and two connecting panels spanning therebetween.

The embodiment of FIG. 13 is generally similar to that of FIG. 1, differing therefrom in three respects. First, the ratio of major to minor dimensions of the body panel **20*e*** is less, on the order of 1.5:1 and consequently the roof line is relatively slack. Second, the tent employs two separate and separated body and end panels assemblies, one within the other. Such construction is known in tent design to be desirable in some circumstances to provide additional protection against the elements and is readily adaptable for use with the present invention.

Figure 14:
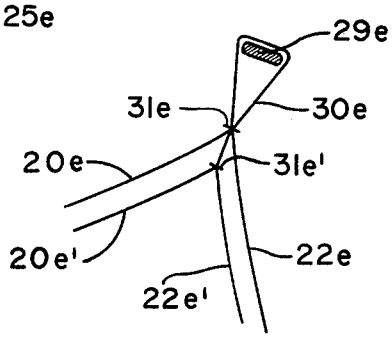
FIG. 14 is a cross-sectional view of the structure of FIG. 13 taken along line 14—14 thereon.

Finally, and as best shown in FIG. 14, the frame receiving pocket is formed externally to the structure and comprises a long strip of material 30*e* folded about the frame member 29*e* and secured by stitching 31*e* to both the inner and outer panels and more particularly to the outer body panel 20*e*, outer end panel 22*e* and the corresponding inner panels 20*e'* and 22*e'*. The inner panels are secured to one another with stitching 31*e'* and the ends thereof are, together with the edges of panels 20*e* and 31*e* secured within the folded strip 30*e*.

Figure 15:
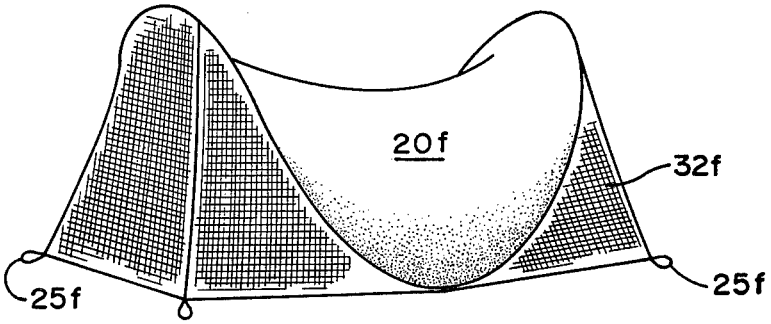
FIGS. 15–17 are isometric views of additional embodiments of the invention.

The embodiment of FIG. 15 utilizes a single body panel 20*f* and a netting panel 32*f* at either end thereof thereby providing a sun and insect protective structure. A floor panel can be used with such a structure but ordinarily is not required.

Figure 16:
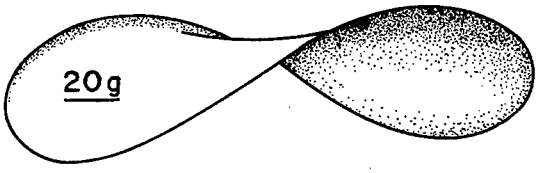

The embodiment of FIG. 16 is the invention in its simplest form comprising only a body 20*g* and a frame as aforedescribed affixed thereto. Such a structure can be used in a variety of applications but is primarily a novelty or toy for children. This embodiment also illustrates the in-use shape of a structure wherein the ratio of major to minor dimensions is only slightly greater than 1:1.

Figure 17:
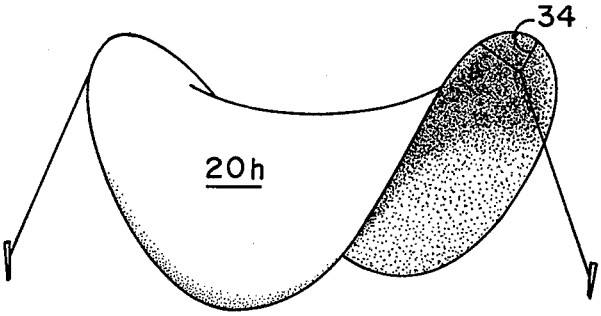

FIG. 17 illustrates a structure similar to that of FIG. 16 except that the major to minor dimensions are in the ratio of about 1.5:1 and tie members 34 are provided at the upper extremities thereof to allow securement thereof to the ground.

While several preferred embodiments utilizing the present invention have been described in detail, such description is intended as illustrative and not limiting and many other variations will occur to those skilled in the art.

What is claimed is:

1. A tent comprising a body of flexible, sheet-like material, a closed loop of a flexible, coilable, springy material as a frame member therefor, said frame member being secured to the periphery of said body in a generally saddle-shaped configuration including two opposed smoothly curved upper ends and opposed smoothly curved lower ends spaced therebetween said lower ends being adapted to be supported by the ground along a limited length thereof, said frame including said length being insufficient to provide stable support to the tent, end panels affixed to said body at each end thereof to form therewith a closed structure said end panels extending beyond the horizontal extent of said body and ties at the lower corners of the end panels adapted to secure the tent to the ground and thereby stably support and tension the tent and hold the frame in the saddle-shaped configuration in use.

2. A tent of claim 1 including a floor affixed to said end panels.

3. The tent of claim 1 wherein said end panels include mesh portions to provide ventillation of the structure.

4. The tent of claim 3 including a floor affixed to said end panels.

5. The tent of claim 1 including additional saddle-shaped body panels and frame members associated therewith and connecting panels between said body panels.

* * * * *